US007921509B2

(12) United States Patent
Oh et al.

(10) Patent No.: US 7,921,509 B2
(45) Date of Patent: Apr. 12, 2011

(54) SUCTION BRUSH FOR USE IN VACUUM CLEANER AND METHOD OF ADJUSTING THE HEIGHT THEREOF

(75) Inventors: Jang-keun Oh, Gwangju (KR); Min-ha Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 312 days.

(21) Appl. No.: 12/010,781

(22) Filed: Jan. 30, 2008

(65) Prior Publication Data

US 2009/0064446 A1 Mar. 12, 2009

(30) Foreign Application Priority Data

Sep. 6, 2007 (KR) ..... 10-2007-0090680

(51) Int. Cl.

| | |
|---|---|
| ***A47L 5/34*** | (2006.01) |
| ***A47L 5/00*** | (2006.01) |
| ***A47L 9/00*** | (2006.01) |
| ***A47L 7/00*** | (2006.01) |

(52) U.S. Cl. ..... 15/358; 15/319

(58) Field of Classification Search ..... 15/319, 15/358, 339

See application file for complete search history.

(56) References Cited

U.S. PATENT DOCUMENTS

| | | | | | |
|---|---|---|---|---|---|
| 2,159,164 | A | * | 5/1939 | Karlstrom | 15/375 |
| 2,312,905 | A | * | 3/1943 | Holm-Hansen | 15/319 |
| 3,599,271 | A | * | 8/1971 | Ljung et al. | 15/259 |
| 3,768,114 | A | * | 10/1973 | Schwartz | 15/319 |
| 4,977,639 | A | * | 12/1990 | Takahashi et al. | 15/319 |
| 6,170,119 | B1 | | 1/2001 | Conrad et al. | |
| 2005/0132522 | A1 | * | 6/2005 | Im et al. | 15/319 |

FOREIGN PATENT DOCUMENTS

| | | |
|---|---|---|
| KR | 20050063547 | 6/2005 |
| KR | 20050063548 | 6/2005 |
| KR | 20070059599 | 6/2007 |
| WO | WO-9006076 A1 | 6/1990 |

* cited by examiner

*Primary Examiner* — Bryan R Muller
(74) *Attorney, Agent, or Firm* — Blank Rome LLP

(57) ABSTRACT

A suction brush for use in a vacuum cleaner and a method of adjusting the height thereof. The suction brush includes a brush casing having a suction opening to draw in air and a main air passage through which the air drawn in through the suction opening flows, a detecting unit disposed to the brush casing to detect a kind of a surface to be cleaned, a lifting unit to move a bottom surface of the brush casing close to and away from the surface to be cleaned, and a driving unit operated in response to a signal generated from the detecting unit and moving the lifting unit using air pressure generated by the air flowing through the main air passage.

15 Claims, 9 Drawing Sheets

SUCTION BRUSH FOR USE IN VACUUM CLEANER AND METHOD OF ADJUSTING THE HEIGHT THEREOF

CROSS-REFERENCE TO RELATED APPLICATIONS

This application claims the benefit under 35 U.S.C. §119 (a) of Korean Patent Application No. 10-2007-90680, filed on Sep. 6, 2007, in the Korean Intellectual Property Office, the entire disclosure of which is incorporated herein by reference in its entirety.

FIELD OF THE INVENTION

The present invention relates to a vacuum cleaner, and more particularly, to a suction brush for use in a vacuum cleaner that can automatically adjust the distance between the surface to be cleaned and the bottom surface of the lower casing of the brush casing in which a suction opening is formed according to whether the surface to be cleaned is a carpet or a hard floor.

BACKGROUND OF THE INVENTION

In general, a vacuum cleaner is an electric appliance that draws in and collects dust or dirt from a surface to be cleaned by using a suction force generated from a vacuum source. Various kinds of vacuum cleaners have been developed, one of which is a canister vacuum cleaner that is generally includes a cleaner body, a connecting unit and suction brush.

Installed in the cleaner body are a vacuum source, such as a suction motor, that generates a suction force and a dust separating part that collects drawn-in dust and/or dirt. The connecting unit includes a handle to be grasped by a user, an extended tube to connect the handle to the suction brush, and a flexible hose to connect the handle to the cleaner body. In addition, the suction brush, which is the portion that comes in contact with the surface to be cleaned and draws in air containing dust and/or dirt, has a suction opening formed in a bottom surface thereof.

As non-limiting examples of the types of surfaces that a vacuum cleaner may clean, there are a hard floors and a carpet. As used herein the term "hard floor" means a surface to be cleaned having a slippery surface made of stone, wood, or floor paper.

If the surface to be cleaned is a hard floor, the suction brush of the vacuum cleaner often sticks to the surface to be cleaned due to the suction force. In this case, a user must exert a large amount of force in handling the suction brush due to the suction brush sticking to the surface to be cleaned. The forces caused by sticking that must be overcome by a user are hereinafter referred to as "operation resistance." By contrast, if the surface to be cleaned is a carpet, the number of times that the suction brush of the vacuum cleaner sticks to the surface to be cleaned is relatively less. When the surface to be cleaned is the carpet, however, a larger suction force is required to draw in dust or dirt from the fibers on the upper surface of the carpet as compared with when the surface to be cleaned is a hard floor.

The operation resistance and the suction force of the suction brush to the surface to be cleaned are closely connected with the height of the suction brush from the surface to be cleaned, i.e., the distance between the surface to be cleaned and the bottom surface of the suction brush in which the suction opening is formed. To be more specific, the smaller the distance between the surface to be cleaned and the bottom surface of the suction brush, the greater the suction force and the greater the operation resistance. Accordingly, the larger the distance between the surface to be cleaned and the bottom surface of the suction brush, the smaller the suction force and the smaller the operation resistance.

When the distance from the bottom surface of the suction brush to the surface to be cleaned is uniformly maintained, a large amount of force is constantly required in handling the suction brush if the surface to be cleaned is a hard floor because the operation resistance of the suction brush is large, and dust and/or dirt are not efficiently drawn in if the surface to be cleaned is a carpet because the suction force is small.

To address the problems described above, a suction brush in which the distance between the bottom surface thereof and the surface to be cleaned can be varied has been developed. In the developed suction brush, a lever, which is manually operated by the user, is exposed at an upper surface of the suction brush. Accordingly, if the surface to be cleaned is a hard floor, the user must manually manipulate the lever to move the bottom surface of the suction brush away from the surface to be cleaned, thereby increasing the distance therebetween and reducing the operation resistance of the suction brush. In addition, if the surface to be cleaned is a carpet, the user must manually manipulate the lever to move the bottom surface of the suction brush closer to the surface to be cleaned, thereby decreasing the distance therebetween and increasing the suction force of the suction brush.

Because the user must manually manipulate the lever of the suction brush whenever the surface to be cleaned is changed, the user is inconvenienced.

SUMMARY OF THE INVENTION

Accordingly, to solve at least the above problems and/or disadvantages and to provide at least the advantages described below, it is a non-limiting object of the present invention to provide a suction brush for use in a vacuum cleaner that includes a brush casing having a suction opening to draw in air and a main air passage through which the air drawn in through the suction opening flows, a detecting unit disposed to the brush casing to detect a kind of a surface to be cleaned, a lifting unit to move a bottom surface of the brush casing close to and away from the surface to be cleaned, and a driving unit operated in response to a signal generated from the detecting unit and moving the lifting unit using air pressure generated by the air flowing through the main air passage.

The detecting unit may include a sensing member disposed in the brush casing and a rotating member rotatably disposed on the brush casing and having a contact part provided at one end thereof to come in contact with the surface to be cleaned and an operating part provided at the other end thereof to switch the sensing member on and off, wherein the sensing member includes an optic sensor having a light emitting part and a light receiving part. In another embodiment, the sensing member may be a hall sensor with the operating part of the rotating member being made of a permanent magnet, or a micro switch.

In yet another embodiment, the detecting unit may include a sensing member disposed on the brush casing and a lifting member disposed on the brush casing and configured to be movable up and down by coming in and out of contact with the surface to be cleaned and having an operating part to operate the sensing member. The sensing member may also includes a micro switch, and the lifting member may includes a rod with one end having a roller part configured to come in contact with the surface to be cleaned, the other end having a supporting part configured to support the lifting member and be move up and down with respect to the brush casing, and a middle having the operating part to operate the micro switch, the lifting member being elastically urged toward the surface to be cleaned by an elastic spring disposed on the lifting member between the brush casing and the operating part.

The lifting unit may a lifting plate configured to be movable up and down and disposed within the brush casing and at least one rib disposed on at least one longitudinal side of the lifting plate and configured to come in contact with the surface to be cleaned.

The driving unit may include a conversion air passage part configured to form a conversion air passage in fluid communication with the main air passage, an air passage closing-up part configured to open and close up the conversion air passage so as to allow or prevent a suction force from being generated in or from the conversion air passage, and a lifting plate-operating part configured to lift and lower the lifting plate when generation of the suction force is allowed or prevented in or from the conversion air passage. The conversion air passage part may include a first conversion air passage guide and a second conversion air passage guide disposed on opposing sides of an air passage guide of a lower casing of the brush casing, thereby forming the main air passage, and a joining guide disposed below the main air passage and formed by an air passage guide of an upper casing of the brush casing so as to join the first conversion air passage guide and the second conversion air passage guide in fluid communication.

The air passage closing-up part may include a driving motor disposed on one side of the lower casing configured to operate in response to the signal generated from the detecting unit and an air passage closing-up plate connected to a driving axis of the driving motor configured to rotate between an open position and a closed position, the air passage closing-up plate being configured to open an upper end of the joining guide in the open position and close an upper end of the joining guide in the closed position. The air passage closing-up part may also include a stop controlling part to control an angle through which the air passage closing-up plate rotates to open and close the upper end of the joining guide, a cam having a cam protrusion disposed on one end of the air passage closing-up plate, and a limit switch configured to be switched on and off by the cam. The air passage closing-up part may also include a power switch part disposed on the lower casing of the brush casing, the power switch part being configured to come in contact with the surface to be cleaned and to disconnect a power supplied to the driving motor when the power switch part is not in contact with the surface to be cleaned.

The lifting plate-operating part may include a first cylinder formed on a lower part of an end of the first conversion air passage guide so that an upper end of the first cylinder is in fluid communication with the conversion air passage and so that a lower end of the first cylinder is open, a second cylinder formed on a lower part of an end of the second conversion air passage guide so that an upper end of the second cylinder is in fluid communication with the conversion air passage and so that a lower end of the second cylinder is open, a first piston projected upward at a first end of a front lifting plate configured to be inserted and slidably disposed in the first cylinder, the first piston being movable to a lifted position that closes the upper ends of the first cylinder or a lowered position that opens the upper end of the first cylinder according to air pressure in the main air passage applied to the first cylinder through the conversion air passage when the air passage closing-up plate is in the open position or the close position, a second piston projected upward at a second end of the front lifting plate configured to be inserted and slidably disposed in the second cylinder, the second piston being movable to a lifted position of closing up the upper ends of the second cylinder or a lowered position that opens the upper end of the second cylinder according to air pressure in the main air passage applied to the second cylinder through the conversion air passage when the air passage closing-up plate is in the open position or the close position, and an elastic member disposed between the upper casing and the lifting plate to elastically urge the lifting plate such that the first and the second pistons are maintained in the lowered position when no air pressure is generated in the main air passage.

According to another embodiment of the present invention, a height adjusting method of a suction brush for use in a vacuum cleaner includes detecting a kind of a surface to be cleaned; and adjusting a distance between a bottom surface of the suction brush and the surface to be cleaned according to the detected kind of the surface to be cleaned using air pressure.

BRIEF DESCRIPTION OF THE DRAWING FIGURES

The above and other aspects and/or advantages of the invention will become apparent and more readily appreciated from the following description of the embodiments, taken in conjunction with the accompanying drawings of which:

DETAILED DESCRIPTION OF AN EXEMPLARY EMBODIMENT

Figure 1:
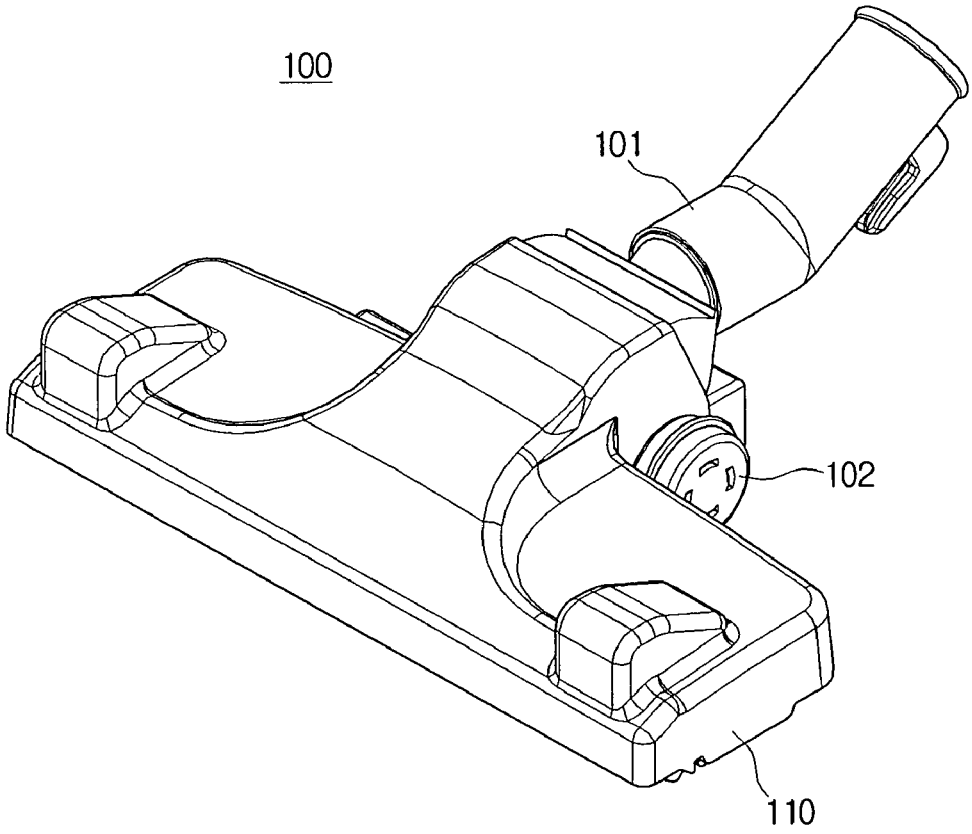
FIG. 1 is a perspective view exemplifying a suction brush for use in a vacuum cleaner in accordance with an exemplary embodiment of the present invention.

Reference will now be made in detail to non-limiting embodiments of the present invention by way of reference to the accompanying drawings, wherein like reference numerals refer to like parts, components and structures.

Figure 2:
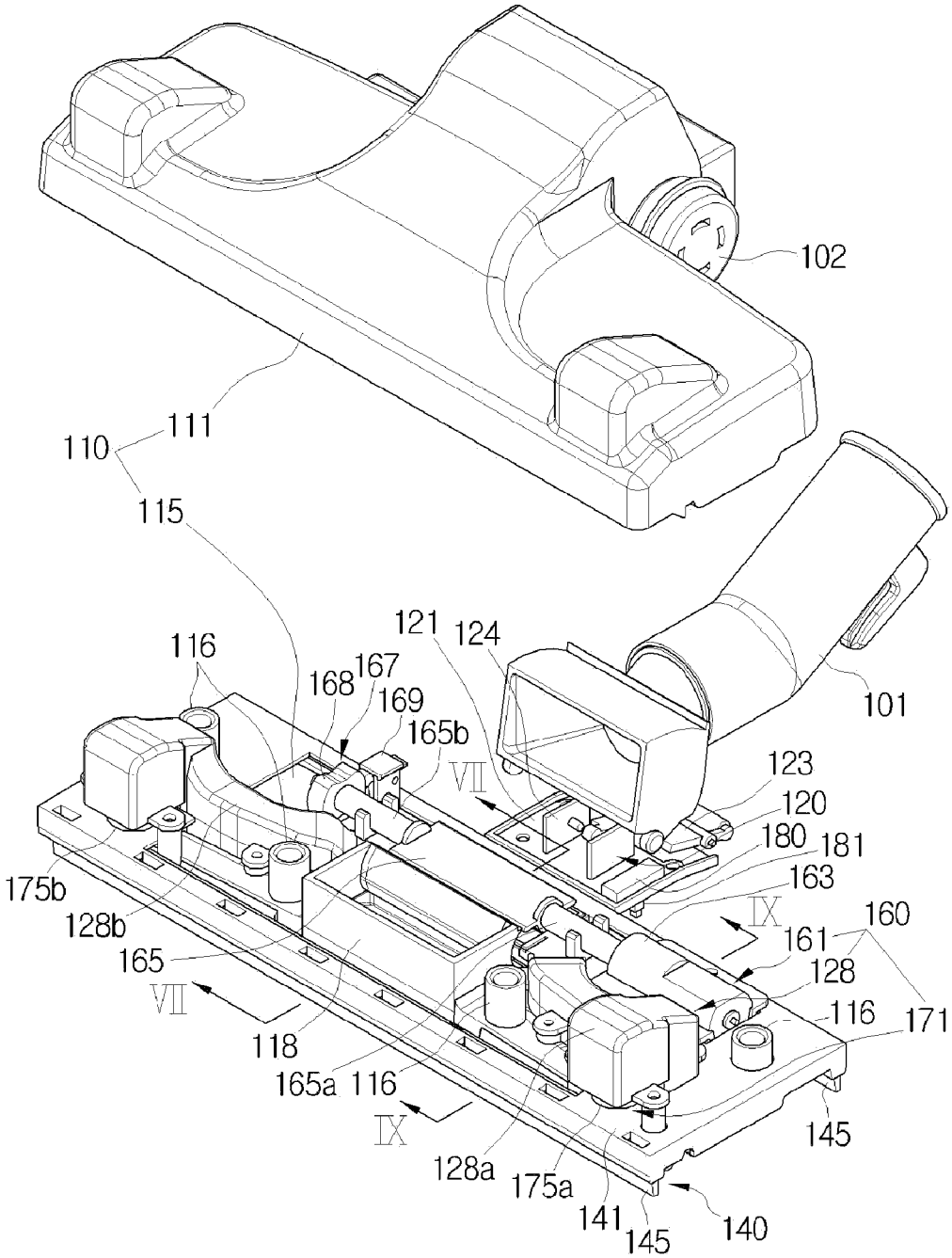
FIG. 2 is an exploded perspective view exemplifying the suction brush of FIG. 1 from which an upper casing of the brush casing is disassembled.

FIG. 1 is a perspective view exemplifying a suction brush 100 for use in a vacuum cleaner in accordance with an exemplary embodiment of the present invention, and FIG. 2 is an exploded perspective view exemplifying the suction brush 100 of FIG. 1 from which the upper casing 111 of the brush casing 110 is disassembled.

Referring to FIGS. 1 and 2, the suction brush 100 for use in the vacuum cleaner in accordance with the exemplary embodiment of the present invention includes a brush casing 110, a detecting unit 120, a lifting unit 140, and a driving unit 160.

Figure 7A:
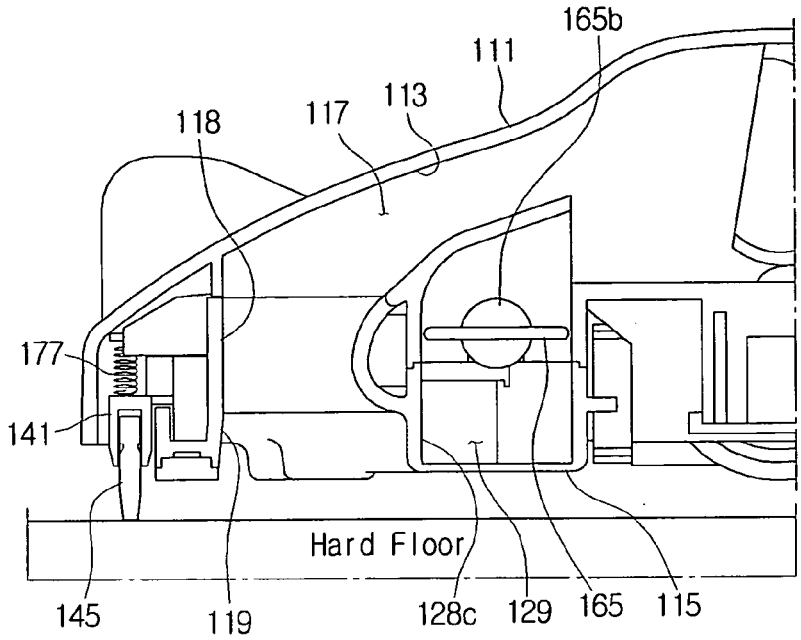
FIGS. 7A and 7B are side cross-sectional views of the assembled suction brush taken along line VII-VII of FIG. 2 to exemplify the operation of the air passage closing-up part of the driving unit of the suction brush illustrated in FIG. 1.
Figure 7B:
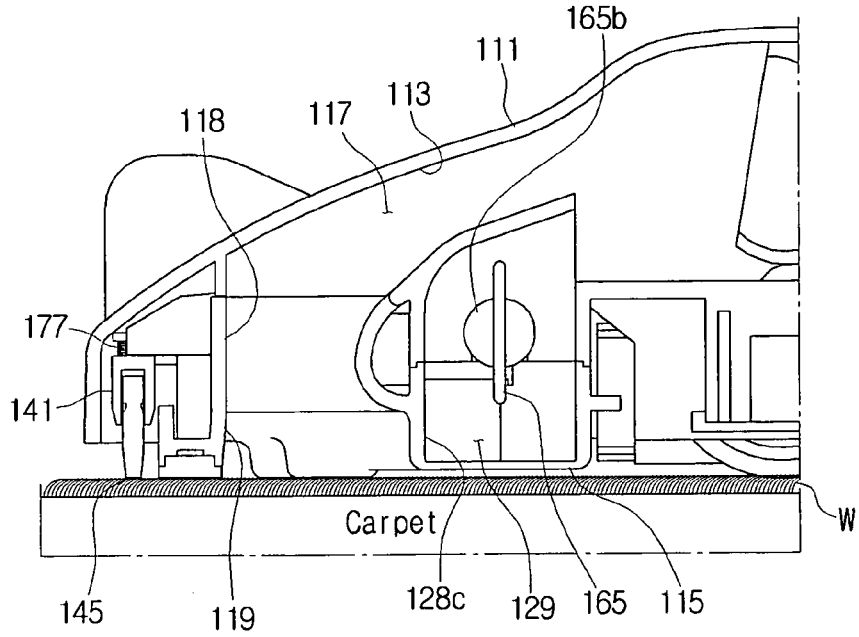

The brush casing 110 includes an upper casing 111 and a lower casing 115. The upper and lower casings 111 and 115 are fixed and joined to each other through screws (not illustrated) and fixing bosses 116 (only fixing bosses of the lower casing illustrated). The lower casing 115 is disposed to face a surface to be cleaned in a cleaning operation. As illustrated in FIGS. 7A and 7B, a suction opening 119 through which air and dust are drawn in from the surface to be cleaned is longitudinally formed in the front of the lower casing 115. The air and the dust drawn in through the suction opening 119 are guided toward an extended tube connector 101 through air passage guides 118 and 113 formed in the lower and the upper casings 115 and 111. Here, the air passage guides 118 and 113 form a main air passage 117 of the suction brush 100.

Referring to FIG. 2, the detecting unit 120 is disposed to the lower casing 115 between suction brush wheels 102 and detects whether the surface to be cleaned is either a hard floor or a carpet. To accomplish this, the detecting unit 120 may include a sensing member 122 and a rotating member 123 as illustrated in FIGS. 3A and 3B.

The sensing member 122 is disposed on a fixing plate 121, and includes an optic sensor 124, such as an infrared sensor, having a light emitting part and a light receiving part. The optic sensor 121 is electrically connected to a controller (not illustrated) in a control panel (not illustrated) of a cleaner body (not illustrated) through a wire, a connecting socket, etc.

The rotating member 123 is rotatably installed on the fixing plate 121 through a rotating axis 123*a*. The rotating member 123 at one end thereof has a contact part 123*b* that is capable of coming in contact with the surface to be cleaned, and at the other end thereof has an operating part 123*c* that is rotatably locatable between the light emitting part and the light receiving part of the optic sensor 124.

Figure 3A:
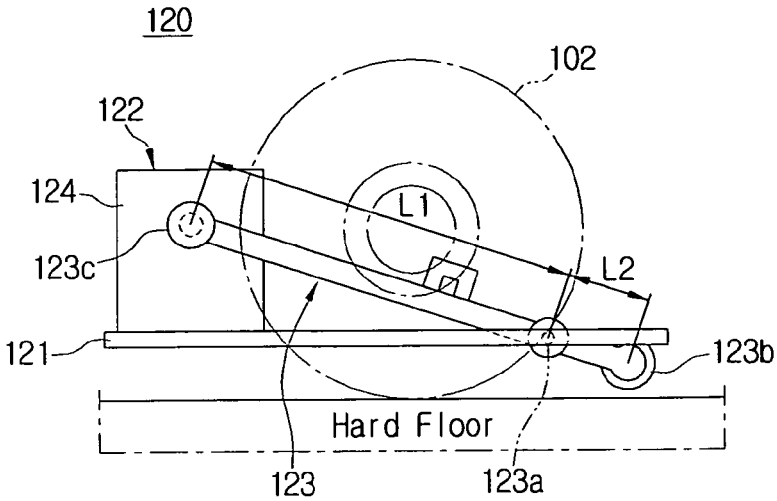
FIGS. 3A and 3B are side elevation views exemplifying the operation of a detecting unit of the suction brush illustrated in FIG. 1.
Figure 3B:
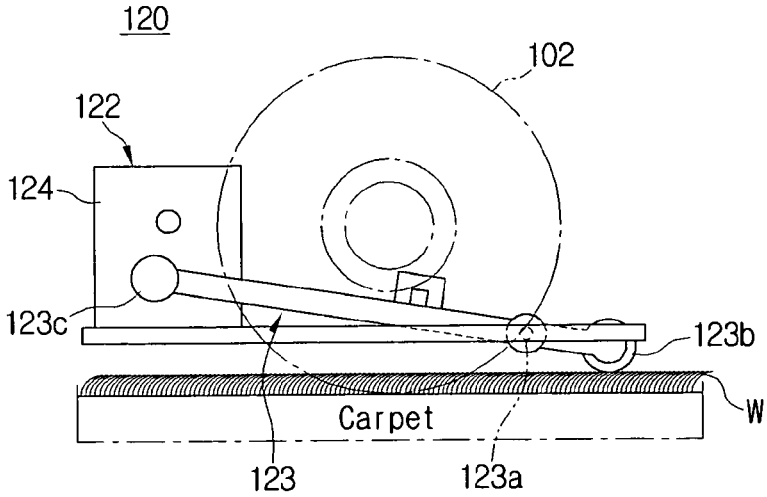

As illustrated in FIG. 3A, the rotating member 123 is configured so that when the surface to be cleaned is a hard floor the contact part 123*b* is positioned apart from the surface to be cleaned and the operating part 123*c* is positioned in a position (referred to as the "OFF" position below) between the light emitting part and the light receiving part of the optic sensor 124 so as to turn off the optic sensor 124. By contrast, when the surface to be cleaned is a carpet, the contact part 123*b* of the rotating member 123 is lifted by a height of fibers "W" that are formed close together on an upper surface of the carpet as illustrated in FIG. 3B. At this time, the rotating member 123 is rotated through a predetermined angle corresponding to the height that the contact part 123*b* of the rotating member 123 is lifted. As a result, the operating part 123*c* of the rotating member 123 is lowered and positioned in a position (referred to as the "ON" position below) away from the OFF position between the light emitting part and the light receiving part of the optic sensor 124 so as to turn on the optic sensor 124. When the optic sensor 124 is turned on, the controller (not illustrated) controls the driving unit 160 to operate the lifting unit 140 as described in more detail below.

The rotating member 123 is formed so that the distance L1 from the rotating axis 123*a* to the operating part 123*c* is larger than the distance L2 from the rotating axis 123*a* to the contact part 123*b*. In the exemplary embodiment of FIGS. 3A and 3B, the distance L1 is configured so that L1 is approximately five times longer than the distance L2. Accordingly, if the contact part 123*b* is lifted by, for example, 1 mm, the operating part 123*c* is lowered up to 5 mm. As a result, even though the height of fibers "W" formed on the upper surface of the carpet is relatively small, the detecting unit 120 can more easily detect that the surface to be cleaned is a carpet.

Figure 4A:
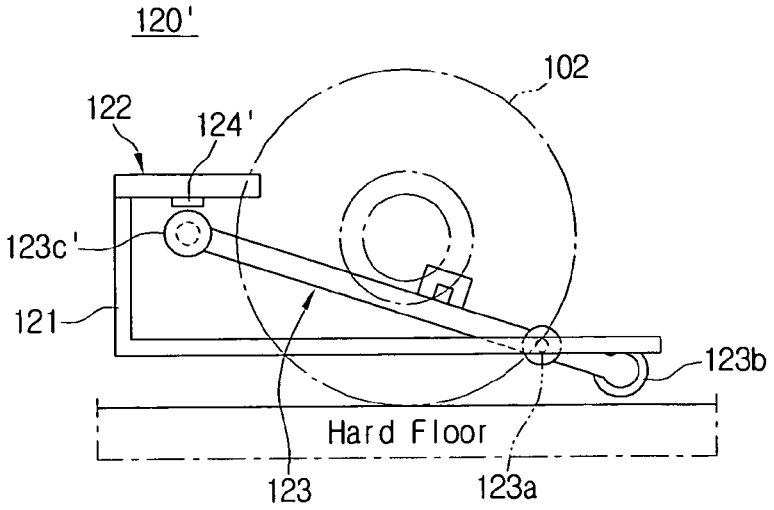
FIGS. 4A and 4B are side elevation views exemplifying the operation of a modified example of the detecting unit of the suction brush illustrated in FIG. 1.
Figure 4B:
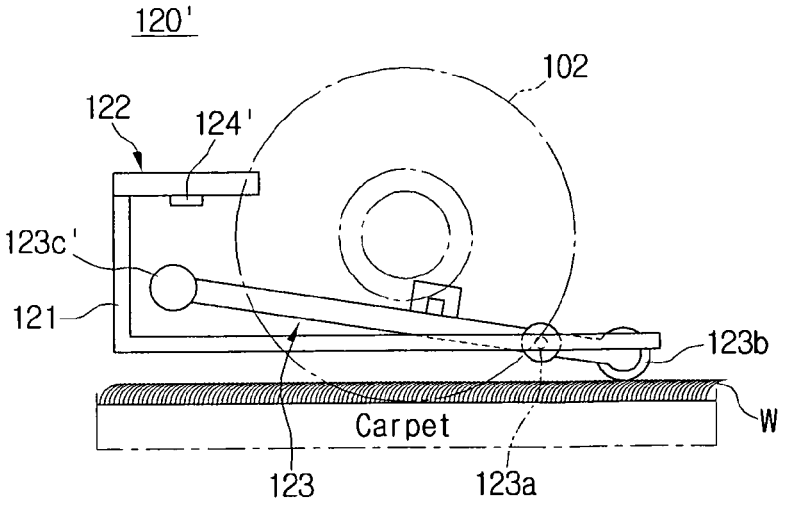

In the above description, although the detecting unit 120 has been explained and illustrated as having the sensing member 122 including of the optic sensor 124, the present invention is not limited thereto. For example, a detecting unit 120' may be constructed as illustrated in FIGS. 4A and 4B so that the sensing member 122 includes a hall sensor 124'. In this exemplary embodiment, an operating part 123*c'* of the rotating member 123 includes a permanent magnet. The detecting unit 120' of this exemplary embodiment operates in substantially the same manner as the detecting unit 120, with the hall sensor 124' being positioned in the OFF position when the operating part 123*c'* of the rotating member 123 is lowered away from the hall sensor 124'.

Figure 5A:
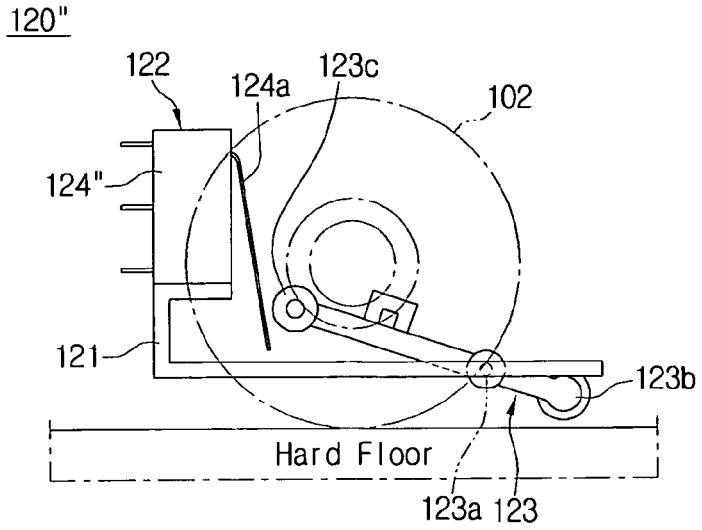
FIGS. 5A and 5B are side elevation views exemplifying the operation of another modified example of the detecting unit of the suction brush illustrated in FIG. 1.
Figure 5B:
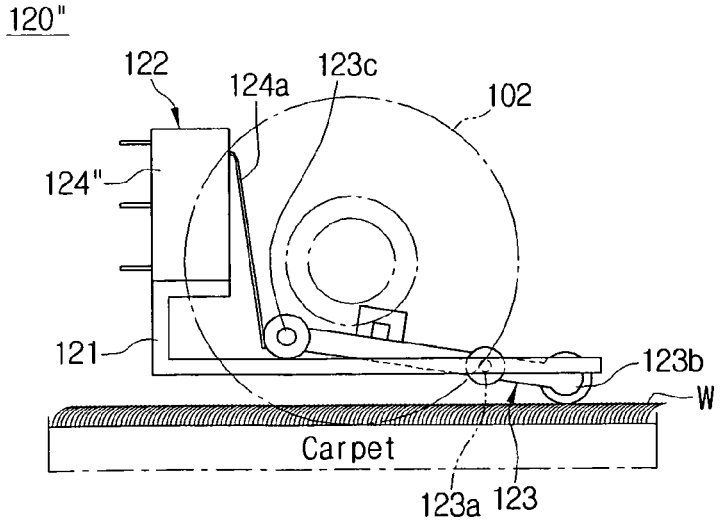

In another exemplary embodiment, a detecting unit 120" may be constructed as illustrated in FIGS. 5A and 5B so that the sensing member 122 includes a micro switch 124" having a switch terminal 124*a*. The detecting unit 120" of this exemplary embodiment operates in substantially the same manner as the detecting unit 120, with the micro switch 124" being positioned in the ON position when the operating part 123*c* of the rotating member 123 is lowered into contact with the switch terminal 124*a*.

Figure 6A:
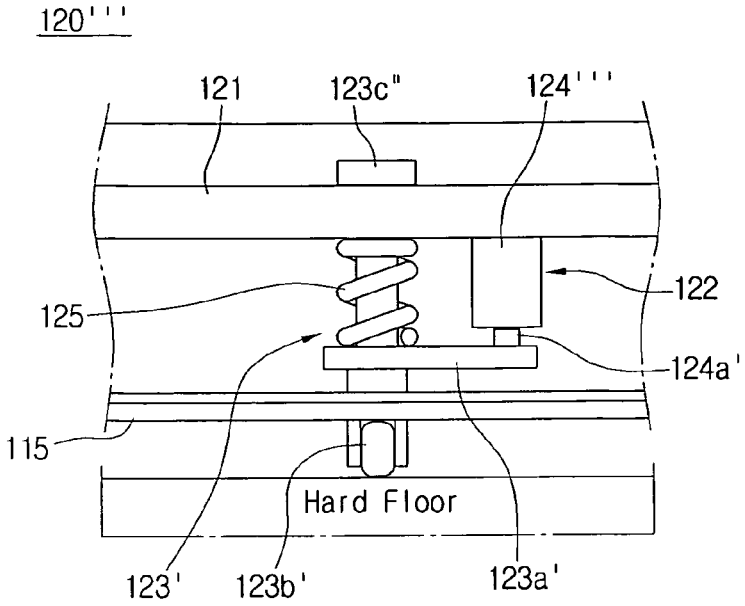
FIGS. 6A and 6B are front elevation views exemplifying the operation of another modified example of the detecting unit of the suction brush illustrated in FIG. 1.
Figure 6B:
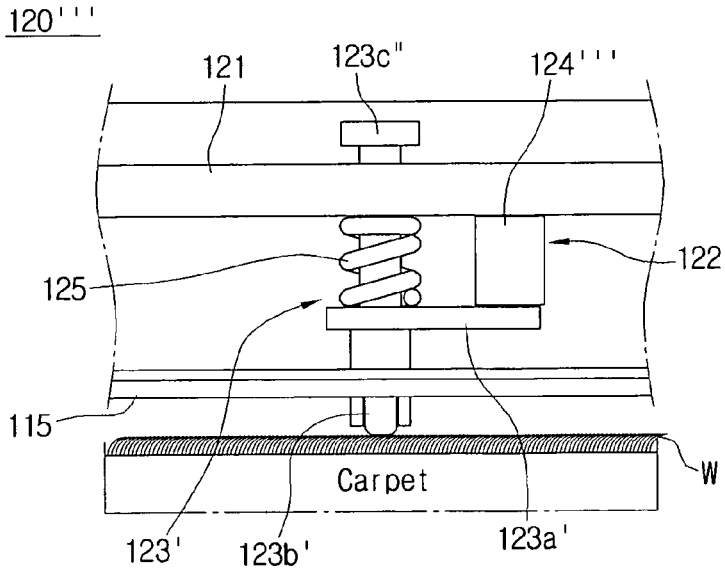

In yet another exemplary embodiment, a detecting unit 120'" may be constructed as illustrated in FIGS. 6A and 6B so that the sensing member 122 is disposed on the fixing member 121 and a lifting member 123' is disposed through the fixing plate 121 of the lower casing 115 so as to be movable up and down based on contact with the surface to be cleaned. The sensing member 122 of this embodiment includes a micro switch 124'" having a switch terminal 124*a'*. The lifting member 123' includes a rod, the lower end of which has a roller part 123*b'* to come in contact with the surface to be cleaned, the upper end of which has a supporting part 123*c"* to support the lifting member 123' against the fixing plate 121 of the brush casing 115, and the middle of which has an operating part 123*a'* to operate the switch terminal 124*a'* of the micro switch 124'". The lifting member 123' is elastically urged toward the surface to be cleaned by an elastic spring 125 that is disposed between the operating part 123*a'* and the fixing plate 121 of the lower casing 115. The detecting unit 120'" of this exemplary embodiment operates in substantially the same manner as the detecting unit 120, with the micro switch 124'" being positioned in the OFF position when the operating part 123*a'* of the lifting member 123' is lowered away from the micro switch 124'".

Referring again to FIG. 2, the lifting unit 140 is configured to move the bottom surface of the lower casing 115 close to or away from the surface to be cleaned, thereby adjusting the distance between the surface to be cleaned and the bottom surface of the lower casing 115, i.e., the height of the suction brush 100. The lifting unit 140 includes a lifting plate 141 and two ribs 145. The lifting plate 141 is configured to move up and down with respect to the lower casing 115 and is disposed between the upper and the lower casings 111 and 115. The lifting plate 141 is installed so that first and second pistons 175*a* and 175*b* (see FIGS. 2, 8A and 8B) of a lifting plate-operating part 171 slide up and down respectively in first and second cylinders 173*a* (only the first cylinder illustrated in FIGS. 8A and 8B). The first and the second pistons 175*a* and 175*b* of the lifting plate-operating part 171 project downward from both ends of the lifting plate 141.

Figure 8A:
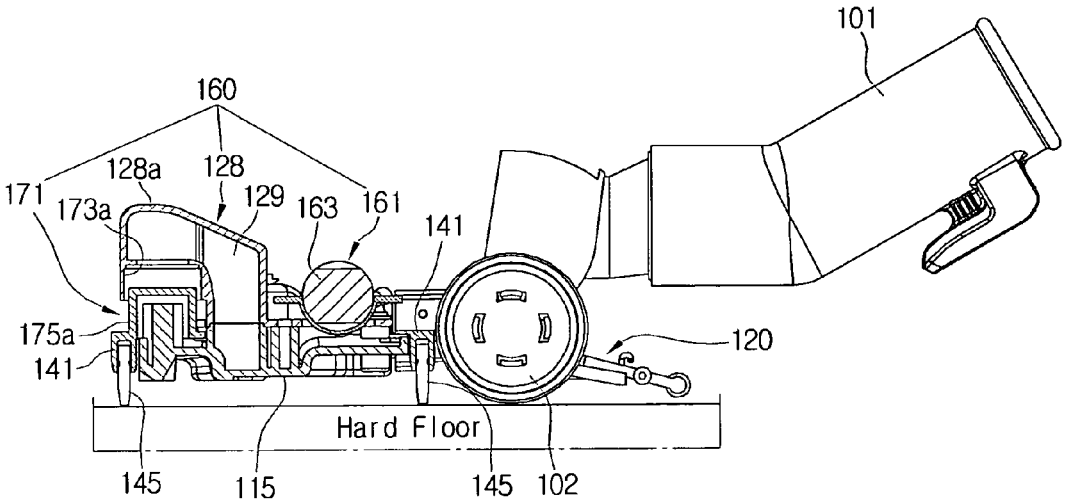
FIGS. 8A and 8B are side cross-sectional views taken along line VIII-VIII of FIG. 2 to exemplify the operation of the lifting plate-operating part of the driving unit of the suction brush illustrated in FIG. 1.
Figure 8B:
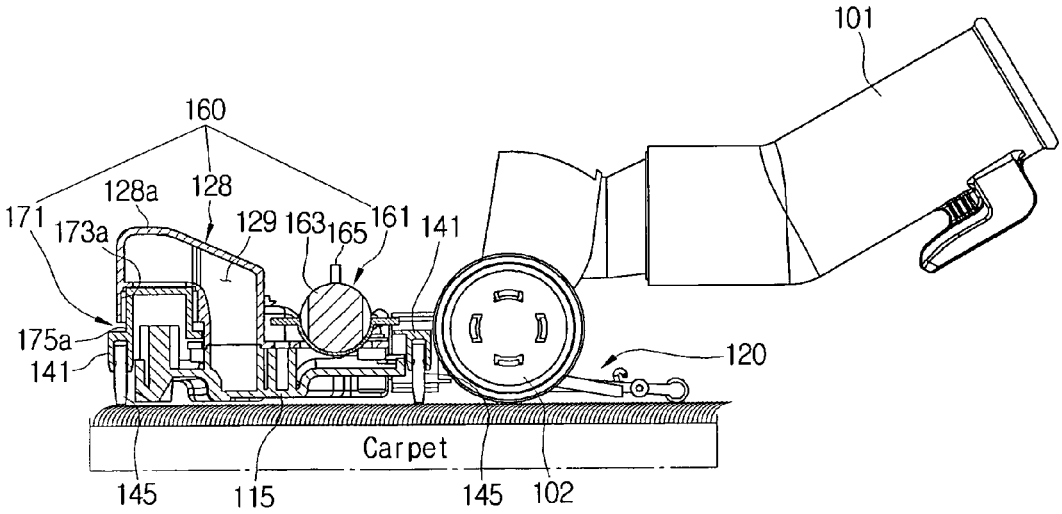
Figure 9:
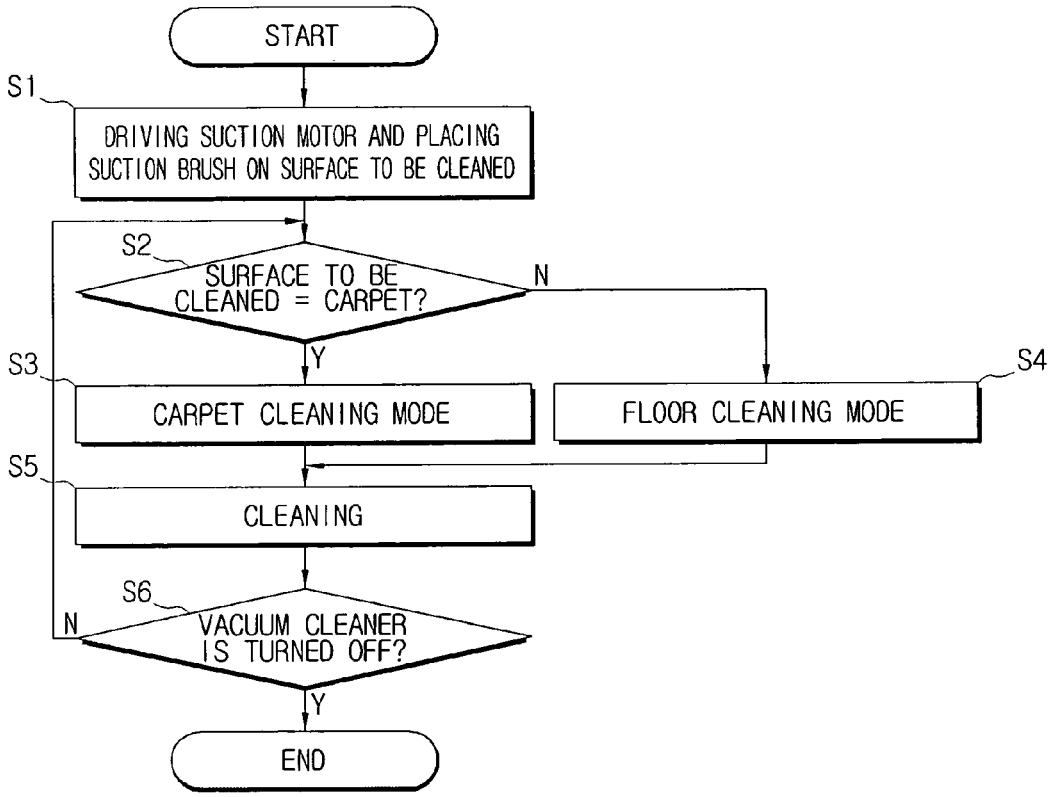
FIG. 9 is a flowchart exemplifying the height adjusting operation of the suction brush illustrated in FIG. 1.

The two ribs 145 are installed to project below installing grooves in front and the rear of the lower surface of the lifting plate 141. In FIGS. 8A and 8B, the two ribs 145 are illustrated as disposed at the front and at the rear of the lower surface of the lifting plate 141, but are not limited thereto. For instance, only a single rib may be disposed at the front of the lower surface of the lifting plate 141.

As illustrated in FIGS. 7B and 8B, when the lifting plate 141 is positioned in a lifted position, the ribs 145 are moved up so that the bottom surface of the lower casing 115 comes close to a top surface of the fibers of a carpet, the carpet being the surface to be cleaned. By contrast, when the lifting plate 141 is positioned in a lowered position as illustrated in FIGS. 7A and 8A, the ribs 145 are projected downward from the bottom surface of the lower casing 115 to come in contact with the upper surface of the floor so that the bottom surface of the lower casing 115 moves away from the upper surface of the floor.

The driving unit 160 is operated according to a signal generating when the optical sensor 124 of the detecting unit 120 is turned on or off and causes the lifting unit 140 to move the bottom surface of the lower casing 115 away from or close to the surface to be cleaned via the controller (not illustrated). As illustrated in FIG. 2, the driving unit 160 includes a conversion air passage part 128, an air passage closing-up part 161, and a lifting plate-operating part 171.

As illustrated in FIGS. 2, 7A and 8A, the conversion air passage part 128, which forms a conversion air passage 129 that may be in fluid communication with the main air passage 117, includes first and second conversion air passage guides 128*a* and 128*b*, each disposed on a side of the air passage guide 118 of the lower casing 115, and a joining guide 128*c* disposed below the main air passage 117. Each of the first and the second conversion air passage guides 128*a* and 128*b* respectively includes the first or second cylinder (only the first cylinder 173*a* is illustrated in FIGS. 8A and 8B) of the lifting plate-operating part 171. As illustrated in FIGS. 8A and 8B, the lower end of each first and second cylinder is opened and the other end is connected with a side of the joining guide 128*c*. The joining guide 128*c* is connected at both ends with the first and the second conversion air passage guides 128*a* and 128*b*. The upper end of the joining guide 128*c* is opened so that the conversion air passage 129 may be in fluid communication with the main air passage 117.

The air passage closing-up part 161 is configured to open and close the upper end of the joining guide 128*c* so as to allow or prevent a suction force to be generated in or from the conversion air passage 129. The air passage closing-up part 161 includes a driving motor 163 and an air passage closing-up plate 165. The driving motor 163 is disposed on one side of the lower casing 115 and operated by the controller (not illustrated) according to the signal generated when the optic sensor 124 of the detecting unit 120 is turned on or off. The driving motor 163 is connected to an external power source or a battery installed in the cleaner body through a power control part (not illustrated) of the controller (not illustrated). The air passage closing-up plate 165 is configured to rotate between a closed position (see FIGS. 7A and 8A) and an open position (see FIGS. 7B and 8B) to close and open the upper end of the joining guide 128*c*, the air passage 129 not being in fluid communication with the main air passage 117 when the closing-up plate 165 is in the closed position and being in fluid communication with the main air passage 117 when the closing-up plate 165 is in the open position. The air passage closing-up plate 165 is connected to a driving axis of the driving motor 163 so that it is rotated between the open and closed position by the driving motor 163. The air passage closing-up plate 165 is rotatably supported at both ends thereof by first and second supporting rods 165*a* and 165*b* rotatably disposed in at first and second supporting brackets.

To control the angle that the air passage closing-up plate 165 rotates to open and close the upper end of the joining guide 128*c*, a stop controlling part 167 is disposed at one end of the second supporting rod 165*b*. The stop controlling part 167 includes a cam 168 having a cam protrusion disposed at the one end of the second supporting rod 165*b* and a limit switch 169 configured to be switched on and off by the cam 168. The limit switch 169 includes first and second switches that have switch terminals disposed at an angle of 90 degrees with respect to each other so that they are switched on by the cam protrusion whenever the cam 168 rotates through an angle of approximately 90 degrees. Accordingly, when under the control of the controller (not illustrated), the driving motor 163 is rotated in, for example, a counterclockwise direction or a clockwise direction to position the air passage closing-up plate 165 in the closed position or the open position, respectively, according to the signal generated at the optic sensor 124 of the detecting unit 120, and the cam protrusion of the cam 168 operates the first or the second switch of the limit switch 169 so that the controller (not illustrated) stops driving the driving motor 163 when the air passage closing-plate 165 reaches the closed position or the open position.

Referring to FIG. 2, the air passage closing-up part 161 includes a power switch part 180 to prevent the driving motor 163 from driving when the suction brush 100 is moved a predetermined distance away from the surface to be cleaned. The power switch 180 part is disposed on the fixing plate 121 and is configured to disconnect the electric power supplied to the driving motor 163 from the battery or the external power source when the suction brush 100 is moved a predetermined distance away from the surface to be cleaned. A power switch 181 is provided on a lower end of the power switch part 180 and is configured to come in contact with the surface to be cleaned. Accordingly, if the suction brush 100 comes in contact with the surface to be cleaned, the power switch 181 also comes in contact with the surface to be cleaned, thereby allowing electric power to be supplied to the driving motor 163 from the battery or the external power source. By contrast, if the suction brush 100 is moved away from the surface to be cleaned, specifically, if it is temporarily lifted to move a predetermined distance away from the surface to be cleaned, the power switch 181 is turned off to disconnect the electric connection between the driving motor 163 and the battery or the external power source, thereby preventing the electric power from being supplied to the driving motor 163 from the battery or the external power source, which prevents the driving motor 163 from unnecessarily driving and rotating.

The lifting plate-operating part 171 is configured to lift and lower the lifting plate 141 as the air passage closing-up part 161 respectively opens and closes the upper end of the joining guide 128*c* so as to allow or prevent a suction force to be generated in or from the conversion air passage 129. The lifting plate-operating part 171 is disposed between the lifting plates 141 and between the first and the second conversion air passage guides 128*a* and 128*b*. As illustrated in FIGS. 2, 7A and 8A, the lifting plate-operating part 171 includes first and second cylinders 173*a* (only the first cylinder illustrated in FIGS. 8A and 8B), first and second pistons 175*a* and 175*b*, and an elastic member 177.

The first and the second cylinders 173*a* are formed at lower parts of an end of each of the first and the second conversion air passage guides 128*a* and 128*b*, respectively. Each of the first and the second cylinders 173*a* is in fluid communication with the conversion air passage 129 at the upper end of each cylinder. The lower end of the first and the second cylinders 173*a* is opened. The first and second pistons 175*a* and 175*b* project upward at the ends of the front lifting plate 141 and are slidably disposed within the first and the second cylinders 173*a*, respectively. The first and second pistons 175*a* and 175*b* may be moved to a lifted position (see FIG. 8B) wherein upper ends of the first and the second cylinders 173*a* are thereby closed, or moved to a lowered position (see FIG. 8A) wherein the upper ends of the first and the second cylinders 173*a* are thereby open and in fluid communication with the conversion air passage 129.

The suction force of a suction motor (not illustrated) of the cleaner body, i.e., the air pressure generated in the main air passage 117, may be applied to the first and the second cylinders 173*a* through the conversion air passage 129 when the driving motor 163 is rotated such that the air passage closing-up plate 165 is in the open position, the suction force thereby causing the first and second pistons 175*a* and 175*b* to move to the lifted position (see FIG. 8B). The driving motor 163 is rotated such that the air passage closing-up plate 165 is in the open position when the signal generated by the optic sensor 124 of the detecting unit 120 is turned ON as described above. When this occurs, the lifting plate 141 is lifted along with the first and the second pistons 175*a* and 175*b*. By contrast, the lifting plate 141 is lowered with the first and second pistons 175*a* and 175*b* when the air passage closing-up plate 165 is in the closed position, which occurs when the signal generated by the optic sensor 124 of the detecting unit 120 is turned OFF as described above. When the air passage closing-up plate 165 is in the closed position, suction force is removed from the first and the second cylinders 173*a*, thereby allowing the first and second pistons 175*a* and 175*b* to move to the lowered position (see FIG. 8A).

The elastic member 177 elastically urges the lifting plate 141 so that the first and the second pistons 175*a* and 175*b* are maintained in the lowered position when the suction force is removed from the first and the second cylinders 173*a*. As illustrated in FIGS. 7A and 7B, the elastic member 177 is sported on a supporting bracket between the upper casing 111 and the lifting plate 141.

As illustrated in FIGS. 7A and 8A, if the surface to be cleaned is a hard floor, the suction force in the main air passage 117 is not applied to the first and the second cylinders 173*a* through the conversion air passage 129 because the driving motor 163 is rotated, for example, in a counterclockwise direction to position the air passage closing-up plate 165 in the close position. This occurs when an OFF signal is generated by the optic sensor 124 of the detecting unit 120. Accordingly, the lifting plate 141 is maintained in a lowered position where it is pressed and lowered downward by the elastic member 177 and the ribs 145 project downward to come in contact with an upper surface of the hard floor. Thus, the bottom surface of lower casing 115 is moved away from the upper surface of the hard floor.

By contrast, as illustrated in FIGS. 7B and 8B, if the surface to be cleaned is a carpet, the suction force in the main air passage 117 is applied to the first and the second cylinders 173*a* through the conversion air passage 129 because the driving motor 163 is rotated, for example, in a clockwise direction to position the air passage closing-up plate 165 in the open position. This occurs when an ON signal is generated by the optic sensor 124 of the detecting unit 120. Accordingly, the first and the second pistons 175*a* and 175*b* slidably disposed in the first and the second cylinders 173*a* are pulled up and moved to the lifted position by the suction force of the main air passage 117. As a result, the lifting plate 141 is maintained in a lifted position against an elastic force of the elastic member 177 by the first and the second pistons 175*a* and 175*b* and the ribs 145 move up into the brush casing 110. Thus, the bottom surface of lower casing 115 is moved closer to the top surface of the fibers "W" of the carpet.

Hereinafter, a height adjusting operation of the suction brush 100 for use in the vacuum cleaner constructed as described above is explained in detail with reference to FIGS. 1 through 3B and 7 through 11.

When the suction motor of the cleaner body is operated after the vacuum cleaner is turned on, the suction brush 100 is placed on a surface to be cleaned (S1). As a result, dust and/or dirt located on the surface to be cleaned is drawn in through the suction opening 119 and the main air passage 117 due to the suction force generated by the suction motor.

The detecting unit 120 detects what kind of the surface is to be cleaned, i.e., whether the surface to be cleaned is a carpet or a hard floor (S2). If the surface to be cleaned is detected as a carpet, the controller (not illustrated) carries out a carpet cleaning mode wherein the bottom surface of the lower casing 115 of the brush casing 110 is moved closer to the top surface of fibers "W" of the carpet (S3). Specifically, the optic sensor 124 generates an ON signal, and the controller (not illustrated) determines whether the position of the air passage closing-up plate 165 stored in a previous cleaning operation was the open position corresponding to the ON signal. If the stored position of the air passage closing-up plate 165 is determined to be the open position, the controller (not illustrated) controls the driving motor 163 not to operate, but to stand by. If the stored position of the air passage closing-up plate 165 is determined to be the closed position, the controller (not illustrated) controls the driving motor 163 to drive in one direction, for example, a clockwise direction in order to rotate the air passage closing-up plate 165 to the open position as illustrated in FIG. 7B. When the cam protrusion of the cam 168 turns the second switch of the limit switch 169 ON, the controller (not illustrated) controls the driving motor 163 to stop.

As the air passage closing-up plate 165 is positioned in the open position as described above, the suction force in the main air passage 117 is applied to the first and the second cylinders 173*a* through the conversion air passage 129. Accordingly, as illustrated in FIG. 8B, the first and the second pistons 175*a* and 175*b* slidably disposed in the first and the second cylinders 173*a* are moved to a lifted position due to the suction force in the main air passage 117. Thus, the lifting plate 141 is maintained in a lifted position against the elastic force of the elastic member 177 by the suction force on the first and second pistons 175 and 175*b*. The ribs 145 are also moved up so that the bottom surface of the lower casing 115 is positioned close to the top surface of the fibers "W" of the carpet. As a result, the lower casing 115 can be maintained in a state where it comes in close contact with the top surface of the fibers "W" of the carpet, as compared with when the surface to be cleaned is the hard floor. By maintaining the lower casing 115 in close contact with the top surface of the fibers "W" of the carpet, the air suction force of the suction brush 100 to the carpet is improved, thereby allowing the suction brush 100 to more efficiently draw in dust and/or dirt located between the fibers "W" of the carpet.

With the lifting plate 141 maintained in a lifted position, a user may move the suction brush 100 along the carpet (S5) so as to clean the carpet. While cleaning the carpet, the user may temporarily lift up the suction brush 100 to move away from the carpet, wherein the detecting unit 120 is changed from a state as illustrated in FIG. 3B to a state as illustrated in FIG. 3A, i.e., the suction brush 100 is changed to a hard floor cleaning mode because the position of the detecting unit 120 now corresponds to that for a hard floor. When the user lifts up the suction brush 100 predetermined distance, however, the power switch 181 of the power switch part 180 (see FIG. 2) provided in the suction brush 100 is turned off, thereby the preventing the driving motor 163 from unnecessarily driving and rotating.

By contrast, if, at step S2 of detecting the kind of the surface to be cleaned, the surface to be cleaned is determined to be a hard floor, the controller (not illustrated) carries out a floor cleaning mode of moving the bottom surface of the lower casing of the brush casing 110 away from the upper surface of the hard floor (S4). Specifically, the optic sensor 124 of the detecting unit 120 generates an OFF signal and the controller (not illustrated) determines whether the position of the air passage closing-up plate 165 stored in the previous cleaning operation was the closed position corresponding to the OFF signal. If the stored position of the air passage closing-up plate 165 is determined to be the closed position, the controller (not illustrated) controls the driving motor 163 not to operate, but to stand by. If the stored position of the air passage closing-up plate 165 is determined to be the open position, the controller (not illustrated) controls the driving motor 163 to drive in the other direction, that is, a counter-clockwise direction in order to rotate the air passage closing-up plate 165 to the close position as illustrated in FIG. 7A. When the cam protrusion of the cam 168 turns the first switch of the limit switch 1690N, the controller (not illustrated) controls the driving motor 163 to stop.

As the air passage closing-up plate 165 is positioned to the close position as described above, the suction force in the main air passage 117 is not applied to the first and second cylinders 173*a* through the conversion air passage 129. Accordingly, the lifting plate 141 is maintained in a lowered position where it is pressed down and lowered by the elastic member 177 and the ribs 145 are projected downward to come in contact with the upper surface of the hard floor so that the bottom surface of the lower casing 115 is maintained a predetermined distance from the upper surface of the hard floor. By maintaining the lower casing 115 predetermined distance from the upper surface of the hard floor, the likelihood of the lower casing becoming stuck to the surface to be cleaned due to the suction force is reduced, and thus an operation resistance of the suction brush 100 is reduced.

With the lower casing 115 maintained a predetermined distance from the upper surface of the hard floor, the user may move the suction brush 100 along the hard floor (S5) so as to clean the hard floor. While cleaning the hard floor, the controller (not illustrated) determines whether the vacuum cleaner is turned off (S6). If the vacuum cleaner is turned off, the controller (not illustrated) finishes the cleaning operation. If vacuum cleaner is not turned off, the controller (not illustrated) repeats the operations of the steps S2 through S5.

As is apparent from the foregoing description, according to the exemplary embodiments of the present invention, the suction brush for use in the vacuum cleaner and the height adjusting method thereof can automatically adjust the distance between the surface to be cleaned and the bottom surface of the brush casing in which the suction opening is formed, according to whether the surface to be cleaned is either the carpet or the hard floor.

While the embodiments of the present invention have been described with reference to certain embodiments thereof, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the invention.

What is claimed is:

1. A suction brush for use in a vacuum cleaner, comprising:

a brush casing having a suction opening to draw in air and a main air passage through which the air drawn in through the suction opening flows;

a detecting unit disposed on the brush casing to detect a kind of a surface to be cleaned;

a lifting unit to move a bottom surface of the brush casing close to and away from the surface to be cleaned; and a driving unit operated in response to a signal generated from the detecting unit and moving the lifting unit using air pressure generated by the air flowing through the main air passage, the driving unit having a conversion air passage in fluid communication with the main air passage;

an air passage closing-up part configured to open and close up the conversion air passage so as to allow or prevent a suction force from being generated in or from the conversion air passage, the air passage closing-up part having a driving motor disposed on a lower casing of the brush casing configured to operate in response to the signal generated from the detecting unit; and an air passage closing-up plate connected to a driving axis of the driving motor configured to rotate between an open position and a closed position, the air passage closing-up plate being configured to open the conversion air passage part in the open position and close the conversion air passage part in the closed position; and an operating part configured to move the lifting unit when generation of the suction force is allowed or prevented in or from the conversion air passage.

2. The suction brush as claimed in claim 1, wherein the detecting unit includes:

a sensing member disposed in the brush casing; and a rotating member rotatably disposed on the brush casing and having a contact part provided at one end thereof to come in contact with the surface to be cleaned and an operating part provided at the other end thereof to switch the sensing member on and off.

3. The suction brush as claimed in claim 2, wherein the sensing member includes an optic sensor having a light emitting part and a light receiving part.

4. The suction brush as claimed in claim 2, wherein the sensing member includes a hall sensor and the operating part of the rotating member includes a permanent magnet.

5. The suction brush as claimed in claim 2, wherein the sensing member includes a micro switch.

6. The suction brush as claimed in claim 1, wherein the detecting unit includes:

a sensing member disposed on the brush casing; and a lifting member disposed on the brush casing and configured to be movable up and down by coming in and out of contact with the surface to be cleaned and having an operating part to operate the sensing member.

7. The suction brush as claimed in claim 6, wherein:

the sensing member includes a micro switch, the lifting member includes a rod, one end having a roller part configured to come in contact with the surface to be cleaned, the other end having a supporting part configured to support the lifting member and be move up and down with respect to the brush casing, and a middle having the operating part to operate the micro switch, the lifting member being elastically urged toward the surface to be cleaned by an elastic spring disposed on the lifting member between the brush casing and the operating part.

8. The suction brush as claimed in claim 1, wherein the lifting unit includes:

a lifting plate configured to be movable up and down and disposed within the brush casing; and at least one rib disposed on at least one longitudinal side of the lifting plate and configured to come in contact with the surface to be cleaned.

9. The suction brush as claimed in claim 8, wherein the operating part is configured to lift and lower the lifting plate when generation of the suction force is allowed or prevented in or from the conversion air passage.

10. The suction brush as claimed in claim 9, wherein the conversion air passage part includes:

a first conversion air passage guide and a second conversion air passage guide disposed on opposing sides of an air passage guide of the lower casing of the brush casing, the air passage guide of the lower casing forming a part of the main air passage; and a joining guide disposed below the main air passage and formed by an air passage guide of an upper casing of the brush casing so as to join the first conversion air passage guide and the second conversion air passage guide in fluid communication.

11. The suction brush as claimed in claim 10, wherein the air passage closing-up plate is configured to open an upper end of the joining guide in the open position and close an upper end of the joining guide in the closed position.

12. The suction brush as claimed in claim 11, wherein the air passage closing-up part includes a stop controlling part to control an angle through which the air passage closing-up plate rotates to open and close the upper end of the joining guide.

13. The suction brush as claimed in claim 12, wherein the stop controlling part includes:

a cam having a cam protrusion disposed on one end of the air passage closing-up plate; and a limit switch configured to be switched on and off by the cam.

14. The suction brush as claimed in claim 11, wherein the detecting unit includes a contact part disposed on the lower casing of the brush casing, the contact part being configured to come in contact with the surface to be cleaned and to disconnect a power supplied to the driving motor when the power switch part is not in contact with the surface to be cleaned.

15. The suction brush as claimed in claim 11, wherein the lifting plate-operating part includes:

a first cylinder formed on a lower part of an end of the first conversion air passage guide so that an upper end of the first cylinder is in fluid communication with the conversion air passage and so that a lower end of the first cylinder is open;

a second cylinder formed on a lower part of an end of the second conversion air passage guide so that an upper end of the second cylinder is in fluid communication with the conversion air passage and so that a lower end of the second cylinder is open;

a first piston projected upward at a first end of a front lifting plate configured to be inserted and slidably disposed in the first cylinder, the first piston being movable to a lifted position that closes the upper ends of the first cylinder or a lowered position that opens the upper end of the first cylinder according to air pressure in the main air passage applied to the first cylinder through the conversion air passage when the air passage closing-up plate is in the open position or the close position;

a second piston projected upward at a second end of the front lifting plate configured to be inserted and slidably disposed in the second cylinder, the second piston being movable to a lifted position of closing up the upper ends of the second cylinder or a lowered position that opens the upper end of the second cylinder according to air pressure in the main air passage applied to the second cylinder through the conversion air passage when the air passage closing-up plate is in the open position or the close position; and an elastic member disposed between the upper casing and the lifting plate to elastically urge the lifting plate such that the first and the second pistons are maintained in the lowered position when no air pressure is generated in the main air passage.

* * * * *